US006877199B2

(12) United States Patent
Cassese et al.

(10) Patent No.: US 6,877,199 B2
(45) Date of Patent: Apr. 12, 2005

(54) PNEUMATIC CRIMPER FOR FITTING FRAME HANGING ATTACHMENTS

(75) Inventors: Pierre Cassese, St. Ouen En Brie (FR); Alain Cassese, Breau (FR); Jean Cassese, Lieusaint (FR); Philippe Cassese, St. Germain Laxis (FR)

(73) Assignee: Societe Cassese S.A., Verneuil l'Etang (FR)

( * ) Notice: Subject to any disclaimer, the term of this patent is extended or adjusted under 35 U.S.C. 154(b) by 0 days.

(21) Appl. No.: 10/169,130

(22) PCT Filed: Dec. 21, 2000

(86) PCT No.: PCT/FR00/03639

§ 371 (c)(1),
(2), (4) Date: Nov. 13, 2002

(87) PCT Pub. No.: WO01/49467

PCT Pub. Date: Jul. 12, 2001

(65) Prior Publication Data

US 2003/0140474 A1 Jul. 31, 2003

(30) Foreign Application Priority Data

Dec. 30, 1999 (FR) ..... 99 16717

(51) Int. Cl.[7] ..... B25B 27/14

(52) U.S. Cl. ..... 29/283.5; 29/281.1

(58) Field of Search ..... 100/285; 29/283.5, 29/261, 251, 252, 255, 280, 281.1; 269/32

(56) References Cited

U.S. PATENT DOCUMENTS

| | | | | |
|---|---|---|---|---|
| 3,173,673 A | * | 3/1965 | Northern et al. | 269/32 |
| 3,281,140 A | * | 10/1966 | Smierciak | 269/24 |
| 3,884,142 A | * | 5/1975 | Jonsson | 100/214 |
| 4,645,113 A | | 2/1987 | Webber | |
| 5,174,004 A | * | 12/1992 | King et al. | 29/251 |
| 6,539,600 B2 | * | 4/2003 | Wu et al. | 29/252 |

FOREIGN PATENT DOCUMENTS

| | | |
|---|---|---|
| EP | 0 899 054 A1 | 3/1999 |
| GB | 396726 | 8/1933 |
| GB | 2 094 222 | 9/1982 |

* cited by examiner

*Primary Examiner*—Lee D. Wilson
(74) *Attorney, Agent, or Firm*—Finnegan, Henderson, Farabow, Garrett & Dunner, L.L.P.

(57) ABSTRACT

A crimping head (2) is hinged, at the upper part, on a horizontal pin (4) mounted at the end of a connecting rod pivotally bearing on a central vertical post (12). This pin enables the head to adopt a position inclined towards the rear of the machine, through the action of a small jack (5), in such a way that its lower end is moved away from the shaped support block (6) serving to hold the fastener in position on the support plate (1).

2 Claims, 2 Drawing Sheets

PNEUMATIC CRIMPER FOR FITTING FRAME HANGING ATTACHMENTS

BACKGROUND OF THE INVENTION

The invention relates to a pneumatic crimper designed for semi-automatically mounting frame fasteners and, more especially, fasteners for frame backs.

There exist several systems for fixing these fasteners, but the fasteners are put in place blindly. A machine for fixing fasteners is also known, in particular, from document GB 396726. When fasteners for frame backs have to be mounted serially, use is preferentially made of an automatic machine. Pneumatic crimpers are also known which essentially comprise a crimping head driven by a jack and capable of exerting a pressure on the fastener positioned blindly on the crimping head in order to press it onto the back of the frame, itself bearing against a support plate. With known crimpers, it does not always prove easy to position the fastener on the head insofar as the crimping head occupies part of the work plane, the recess for receiving the fastener not always being clearly visible.

SUMMARY OF THE INVENTION

To overcome these drawbacks, the Applicant has devised and developed a system that consists in positioning the fastener, not on the crimping head but on the support plate, and which consequently makes provision for temporarily moving aside the end of the crimping head in order to access the work plane easily and position the fastener thereon quickly and correctly.

The main object of the invention is thus a pneumatic crimper for mounting frame fasteners comprising a vertically moving crimping head, a jack for causing the head to move downwards and driving a fastener into a piece of cardboard, and a shaped support block located on a support plate for positioning the fastener, a crimper wherein the crimping head is mounted so that it can be moved clear of the zone for positioning the fastener on the support plate towards the rear of the pneumatic crimper, through the action of a control mechanism.

According to one advantageous characteristic of the invention, the crimping head hinges at the upper part on a horizontal pin so to be able to adopt a position inclined toward the rear of the machine through the action of a small jack, so that its lower end is moved away from the zone for positioning the fastener on the support plate.

BRIEF DESCRIPTION OF THE DRAWINGS

Further advantages and characteristics of the invention will emerge from the following description of an exemplary embodiment wherein reference is made to the annexed drawings, in which.

DETAILED DESCRIPTION OF THE INVENTION

Figure 1:
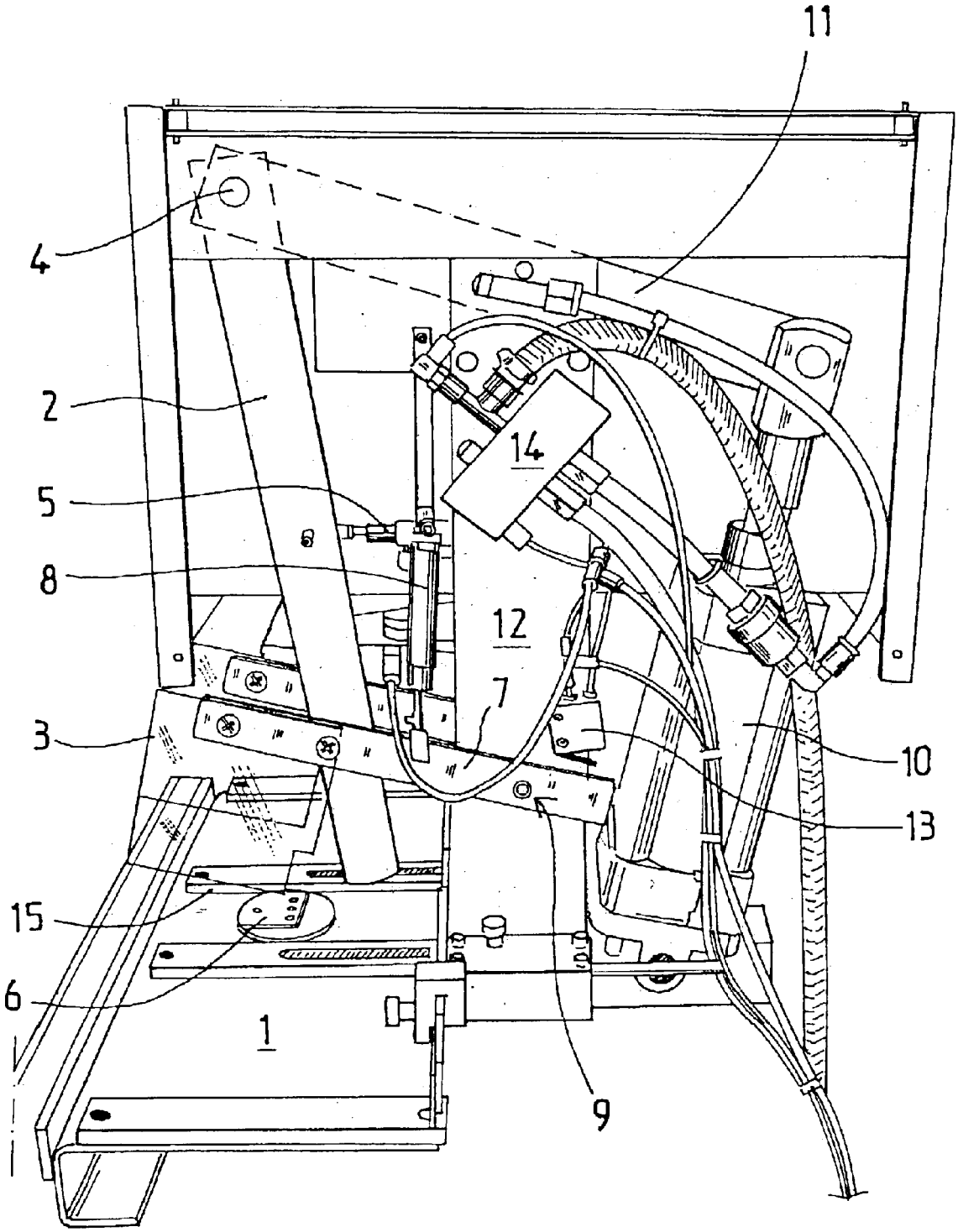
FIG. 1 is a perspective side view of the crimper in rest position.

The crimper shown in the drawings essentially comprises a support plate 1 for positioning the cardboard and the fastener on a shaped support block 6 with which the plate is equipped, a crimping head 2 for driving in the fastener, and mechanisms for manoeuvring a protective cover 3 and the head.

The head, which extends vertically in the crimper, above the table, hinges, at the upper part, about a horizontal pin 4. It can thus pivot, through the action of a small jack 5, between two positions: a first, vertical position, in which the end of the head is vertically above the fastener, and a second, inclined position, in which the head is swung back towards the rear of the machine, and thus leaves the fastener positioning zone clear.

FIG. 1 shows the head in inclined position, its end being thus moved away rearwards. The user thus has easier access to the shaped support block in order to position and drive in the fastener. The plate is also equipped with guide bars 15 making it easier to put the cardboard into place correctly, and between which is located the shaped support block 6. In this position, the protective cover 3 is raised. It is mounted on arms 7 operated by a jack 8 and pivoting about a horizontal pin 9.

Figure 2:
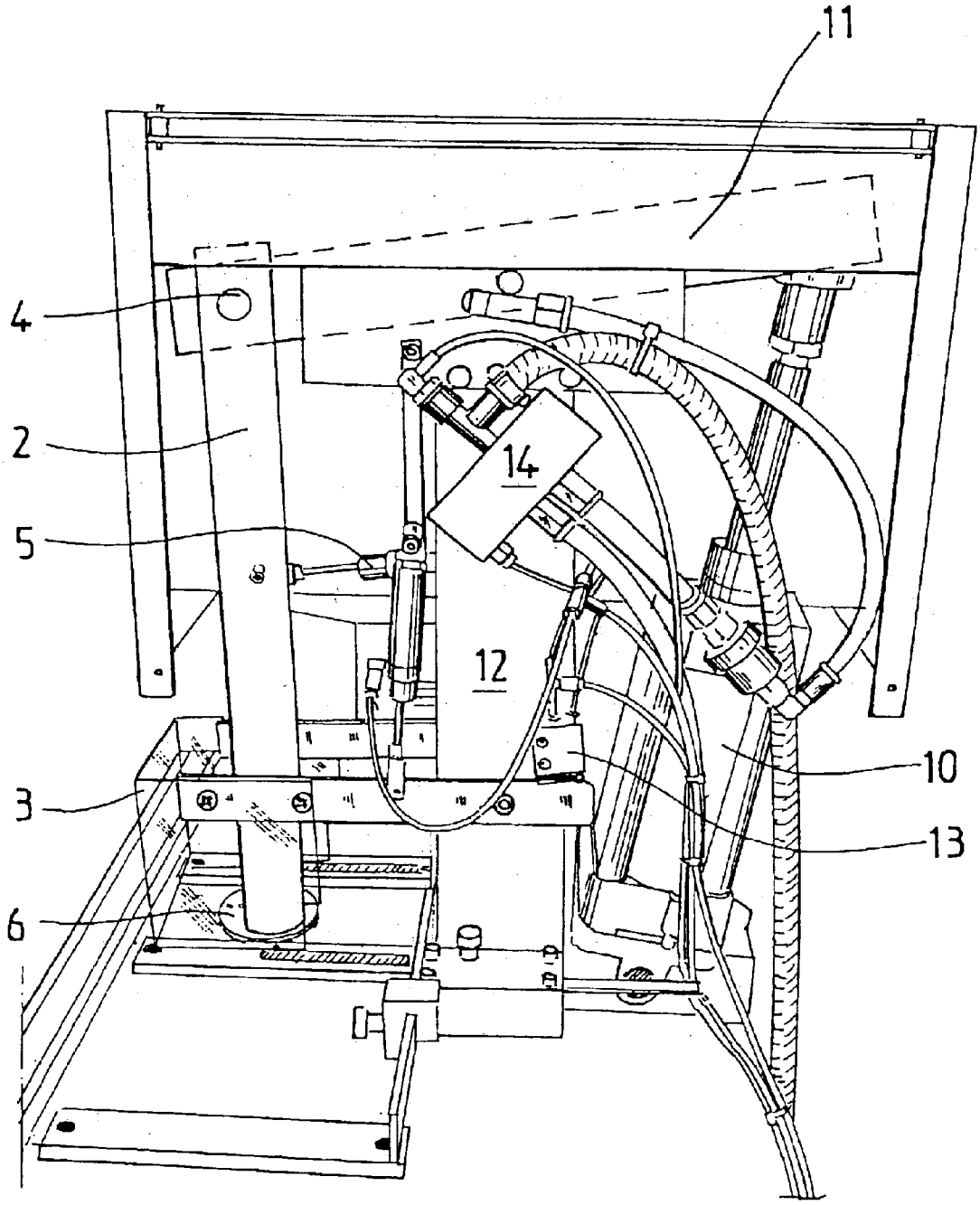
FIG. 2 is a view according to FIG. 1 showing the crimper in operation, with the crimping head in lower position.

FIG. 2 shows crimping head 2 in the vertical position, with its end bearing on support block 6. For this purpose, the head has pivoted through the action of jack 5, and its downward movement has been ensured thanks to a main jack 10 via a connecting rod 11 pivotally bearing on a central post 12. Horizontal pin 4 is at the end of connecting rod 11. A switch 13 is mounted on the end of an arm 7 and is connected to the control box of a pneumatic distributor 14, advantageously mounted on the central post.

The crimping operations take place as follows. With the machine ready to operate as shown in FIG. 1, the operator can introduce a fastener beneath cover 5 and set it easily in place on shaped support block 6. The operator then slides the cardboard of the frame over support plate 1, and positions it by means of guide bars 15 and the stops provided on the plate.

As the crimping head is moved clear to the rear, its travel between the upper position (FIG. 1) and the lower position (FIG. 2) can be reduced by comparison with that of known crimpers, which simplifies the mechanisms involved.

The operator then acts on a pneumatic pedal for controlling the machine, which has the effect, initially, of lowering protective cover 3, the arms of which have pivoted through the action of jack 8 (FIG. 2). Then, small jack 5 acts to cause crimping head 2 to swing forwards by pivoting about its pin 4. The end of the head is then located vertically above the fastener, covered by the cardboard above support block 6. The crimping operation then takes place. Main jack 10 swings connecting rod 11, which causes crimping head 2 to move down to the cardboard of the frame, exerting sufficient pressure to drive the fastener into the back of the cardboard. Any traces left on the cardboard by the crimping head are located on a face that is hidden. Switch 13 is a safety means ensuring that the cover is lowered to allow the crimping operation properly speaking to be carried out in complete safety.

The invention is not limited to the exemplary embodiment described above but also covers devices in which the crimping head is mounted in such a way as to move clear, in any way whatsoever, of the zone for positioning the fastener on the support plate, through the action of a suitable control mechanism.

What is claimed is:

1. A pneumatic crimper for mounting frame fasteners, comprising a vertically moving crimping head, a jack for causing the crimping head to move downwards and drive a fastener into a piece of cardboard, and a shaped support block located on a support plate for positioning the fastener to be driven into the piece of cardboard by the crimping head, wherein the crimping head hinges, at an upper part thereof, on a horizontal pin, said crimping head pivoting about said pin so as to be able to adopt a position inclined toward the rear of the pneumatic crimper through the action of a control mechanism, whereby a lower end of the crimping head is moved away from the zone for positioning the fastener on the shaped support block.

2. The pneumatic crimper of claim 1, wherein the control mechanism is a jack.

* * * * *